US008991316B2

(12) United States Patent
Berger

(10) Patent No.: US 8,991,316 B2
(45) Date of Patent: Mar. 31, 2015

(54) GAS CONTROLLED DELAY TIMING DEVICE

(71) Applicant: Rory Berger, Woodinville, WA (US)

(72) Inventor: Rory Berger, Woodinville, WA (US)

( * ) Notice: Subject to any disclaimer, the term of this patent is extended or adjusted under 35 U.S.C. 154(b) by 0 days.

(21) Appl. No.: 14/070,279

(22) Filed: Nov. 1, 2013

(65) Prior Publication Data

US 2014/0116280 A1 May 1, 2014

Related U.S. Application Data

(60) Provisional application No. 61/721,413, filed on Nov. 1, 2012.

(51) Int. Cl.

| | |
|---|---|
| ***F42B 12/46*** | (2006.01) |
| ***B65D 83/20*** | (2006.01) |
| ***F42C 15/28*** | (2006.01) |
| ***F42B 12/50*** | (2006.01) |
| ***F42C 9/06*** | (2006.01) |

(52) U.S. Cl.

CPC ..... *B65D 83/207* (2013.01); *F42C 15/28* (2013.01); *F42B 12/50* (2013.01); *F42C 9/06* (2013.01)

USPC ..... 102/228; 102/264; 102/276; 102/277

(58) Field of Classification Search

CPC ..... F42C 9/06; F42C 15/28; F24B 12/50

USPC ..... 102/221, 228, 232, 238, 248, 255, 257, 102/264, 276, 277

See application file for complete search history.

(56) References Cited

U.S. PATENT DOCUMENTS 3,785,569 A * 1/1974 Helmrich ..... 239/337

* cited by examiner

*Primary Examiner* — Samir Abdosh
(74) *Attorney, Agent, or Firm* — Dean A. Craine

(57) ABSTRACT

A delay release device that connects to an aerosol filled canister that releases the aerosol in a delayed manner. The device includes a main body with a first plunger assembly mounted on one end. Formed adjacent to the first plunger assembly is a first chamber filled with a compressed gas pressurized from 40 to 150 psi based on the time delay desired. In the main body adjacent to the first chamber is a second chamber and a third chamber. Located inside the third chamber is a second plunger with a hollow stem introduced into a top valve assembly on the canister. To activate, the first plunger assembly is pressed inward which activates a second valve disposed between the first and second chambers. The second valve allows compressed gas to flow slowly from the first chamber into the second chamber and into the third chamber. The increased air pressure in the upper portion of the third chamber exerts a downward force on the second plunger which forces the hollow stem into canister and causes the aerosol gas to be released into a lower discharge chamber and then through holes formed on the main body.

3 Claims, 2 Drawing Sheets

GAS CONTROLLED DELAY TIMING DEVICE

This utility patent application is based on and claims the priority filing date of U.S. Provisional Patent Application No. 61/721,413, filed on Nov. 1, 2012.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to delay timing devices, and more particularly to delay timing devices that can be easily adaptable, if desired, to adjust the time delay.

2. Description of the Related Art

Pressurized gas, smoke and percussion canisters are sometimes launched by riot police and military personnel into an area or building to force occupiers or protestors to leave the area or building. Sometimes, it is desirable to delay activation of the canister a few seconds after deploying it to prevent detection and to give the riot police and military personnel sufficient time to install face masks or to evacuate the target area. The desired time delay for activation of the canister may vary according to many factors, such as the nature of the gas composition in the canister, the location and distance the target area or location is from the launch location, the number of occupiers or protestors, the size and shape of the area or building, and urgency for occupiers or protestors to leave the area or building.

There are different manufacturers of gas canisters which use a top mounted plunger style, canister valve assembly that must be activated in order to release the gas contained inside the canister. Typically, the gas canisters are manually activated by a plunger and then thrown towards the desired target. When activated, the aerosol gas inside the canister is immediately released and completely dispersed in 2 to 10 seconds. As the canister is thrown, smoke or aerosol gas is released. Also, if the desired target area is far away from the launch site, a large portion of the smoke or aerosol gas may be dispersed prior to reaching the target area.

What is needed is a delay timing device that can be used with a standardized pressurized gas canister used by riot police and military personnel. Such a device should be simple to operate and use mechanical components controlled by pressurized gas and not mechanical springs, electrical components, or batteries. Such a device should be relatively small and compact, relatively inexpensive and can be selectively attached or detached to different canisters. The device should include a simple design that can be easily adjusted for different time delay periods.

SUMMARY OF THE INVENTION

Disclosed herein is a gas flow dependent delay timing device that selectively connects to a pressurized gas dispersal canister used in the prior art. The device includes a main body that selectively attaches over the top valve assembly on the canister.

The device's main body includes three stacked air chambers that control the release and flow of compressed air from one chamber into an adjacent chamber and eventually causes activation of the top valve assembly. The main body includes an upper opening with an external pressure activated plunger assembly mounted thereon. In the embodiment shown, the external pressure is created by a handle that the user manually forces inward.

The plunger assembly includes a closed first chamber filled with a compressed gas. The pressure of the compressed gas in the first chamber may be increased or decreased during manufacturing to decrease or increase the time delay respectively. Located inside the main body and adjacent to the first chamber is a lower second chamber normally exposed to atmospheric air. The plunger assembly includes a longitudinal movement activated valve which is forced inward and presses against a post which allows compressed air in the first chamber to flow and pressurize the second chamber. In the embodiment presented, an external handle is attached to an end cap that covers the first air valve used to fill the first chamber with compressed air. When the handle is pressed inward, the entire plunger assembly is pressed inward in the main body causing the compressed air to flow into the secondary chamber.

A locking means is provided that holds the plunger assembly in the activated position. In the embodiment show, the means for holding is a compression ring located on the inside surface of the main body which engages the plunger assembly. A means for sealing, such as an o-ring, is disposed around the outer surface of the plunger assembly and the inside surface of the main body which enables the second chamber to be pressurized upon activation of the timer.

Located inside the main body and below and adjacent to the second chamber is an intermediate strut. Formed on the opposite side of the intermediate strut is a partially sealed third chamber. At least one air conduit is formed on the intermediate strut so that when compressed gas flows into the second chamber it then flows into the third chamber. The size and number of air conduits in the intermediate strut may be adjusted by the manufacturer to control how quickly compressed air flows from the second chamber into the third chamber. Located inside the third chamber is a second plunger with a hollow stem. When the main body is longitudinally aligned and attached to the gas canister, the hollow stem on the second plunger partially extends into the canister's valve assembly but does not activate the valve assembly.

When sufficient compressed air enters the third chamber to force the plunger body inward, the hollow stem is forced into the canister causing the aerosol gas to flow quickly into the hollow stem and into a lower discharge chamber in the device's main body. The lower discharge chamber is located below the second plunger. Holes formed in the side of the main body surrounding the lower discharge chamber allow the aerosol gas to escape into the environment.

In summary, after the device is assembled, an external compressed air source is connected to an air valve attached to the plunger assembly. The first chamber is then filled with the desired amount of compressed air (40-150 psi). When the plunger assembly is manually forced inward, the compressed air in the first chamber is sequentially released and flows into the second chamber and then into the third chamber. The third chamber is divided into two stacked smaller chambers by a second plunger assembly. When sufficient force is exerted on the second plunger assembly, the second plunger assembly is forced inward forcing the hollow stem into the canister's valve assembly. Pressurized gas then travels into the lower discharge chamber and eventually dispersed through side openings in the main body to the environment. Thus, a simple mechanical time delay mechanism is provided for a canister that is relatively inexpensive and less prone to failure. Because the pressure of the gas in the canister is predetermined, the manufacturer can provide devices with different delay timings to allow the user to throw different canisters with the desired time delay. In some instances, the manufacturer can also change the diameters of the air conduits, the size and number of air conduits between the first, second, and third chambers, and the volumes of the first, second and third chambers, to adjust the time delay period.

DESCRIPTION OF THE PREFERRED EMBODIMENT(S)

Figure 1:
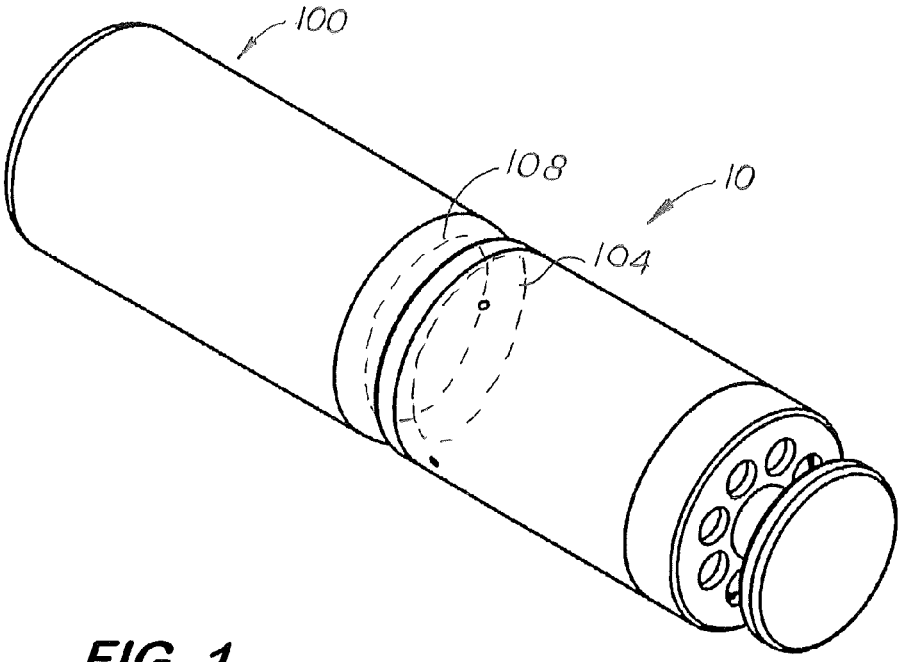
FIG. 1 is a perspective view of a delayed release pressurized gas canister.

Disclosed herein is delay timing device 10 that selectively connects to a pressurized gas or smoke filled canister 100. The device 10 is a small compact structure that selectively attaches to the top valve assembly 108 commonly used on the canister 100. The canister 100 includes a closed bottle 102 with upper cap assembly 104. Located inside the upper cap assembly 104 is the top valve assembly 108, Formed on the outer surface of the upper cap assembly 104 are external threads 110. The canister 100 is filled with a pressurized aerosol gas 112.

The device 10 is designed to selectively attach to the upper cap assembly 104 on the canister 100. The device 10 includes a cylindrical main body 12 with an upper opening and lower opening 14. Mounted over the upper opening 13 is an external pressure activated first plunger assembly 20. The first plunger assembly 20 includes a cylindrical inner body 22 configured to fit and move longitudinally a short distance inside the upper portion of the main body 12. The first plunger assembly 20 also includes an inner cap 24 with a threaded neck 26. Extending over the upper opening 13 is an outer cap 28 with internal threads 30 that connect to external threads 18 formed on the outside surface of the main body 12 near the upper opening 13. During assembly, the outer cap 28 is placed over the upper opening and the threads 18 and 30 are engaged to hold the outer cap 28 in place on the main body 12. The top surface of the inner body 22 includes a threaded neck 26 that attached to a T-shaped handle 38 that extends through a center bore formed on the outer cap 28. Located inside the neck 26 is a first valve 27.

Figure 3:
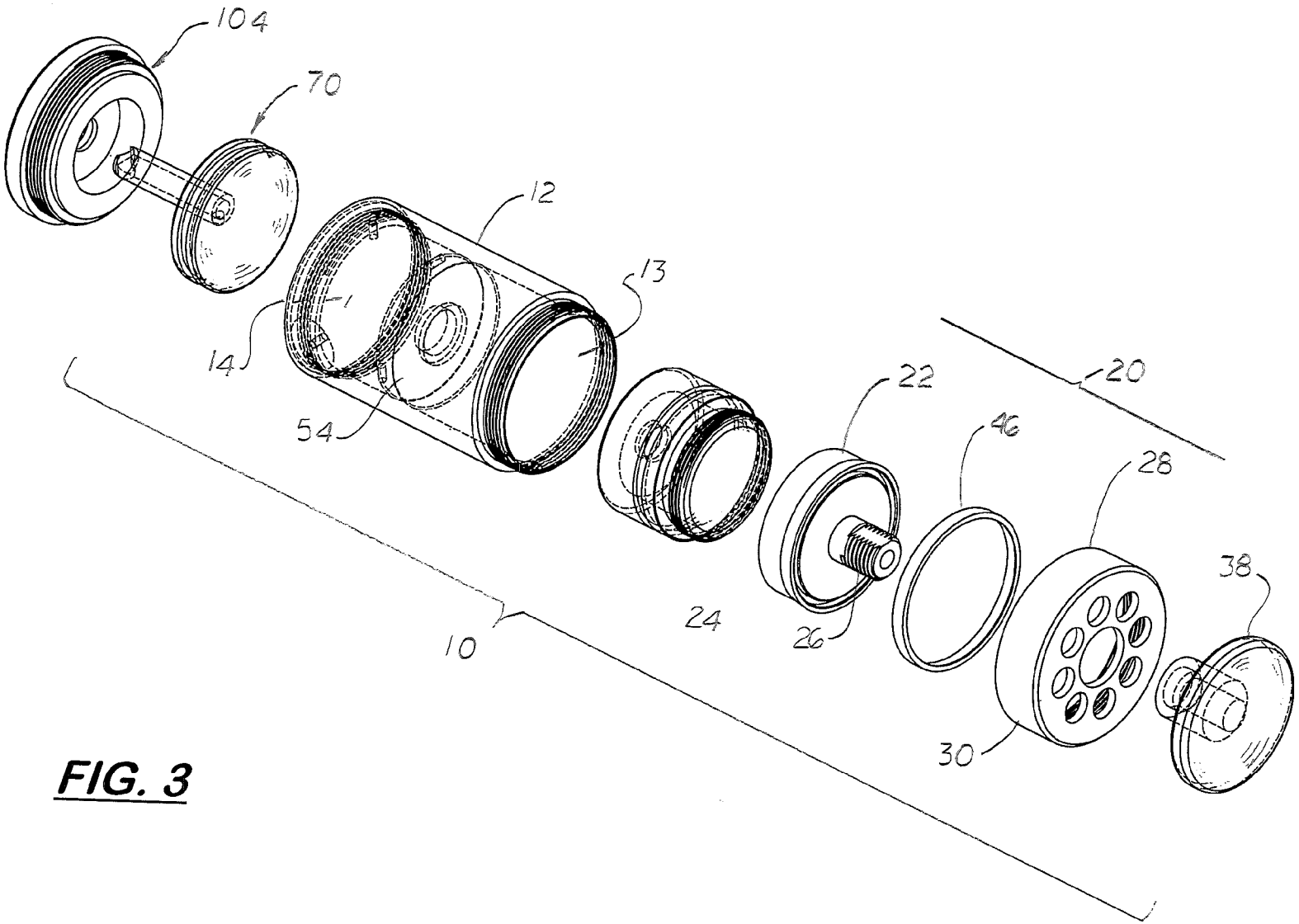
FIG. 3 is an exploded view of the delayed released pressurized gas canister.

As shown in FIG. 3, the inner body 22 is a closed structure with a first cavity 40 formed therein when the inner cap 24 is attached thereto. Extending downward from the lower surface of the inner body 22 is a second valve 42 with a cylindrical hollow neck with a coaxially aligned, activation pin 44 located therein. The end of the hollow neck is open and configured to receive post 56. The activation pin 44 extends from the upper section of the secondary valve 44 to the space inside the hollow neck. When the plunger assembly 20 is pressed inward, the secondary valve 42 is forced towards the intermediate strut 54 and the post 56 extends into the hollow neck and presses against the activation pin 44. The activation pin 44 is then forced outward and communicates with the first chamber 40 and allows compressed air 90 to flow into the secondary chamber 50.

A compression ring 46 is located around the outer side wall of the inner body 22 and near the upper opening 13. During use, the handle 38 is pressed inward which forces the inner body 22 inward on the main body 12. The inner body 22 moves pass the compression ring 46 enabling it to snap into a locking position and prevent the upward movement of the inner body 22 in the main body 12 to its original location.

Figure 2:
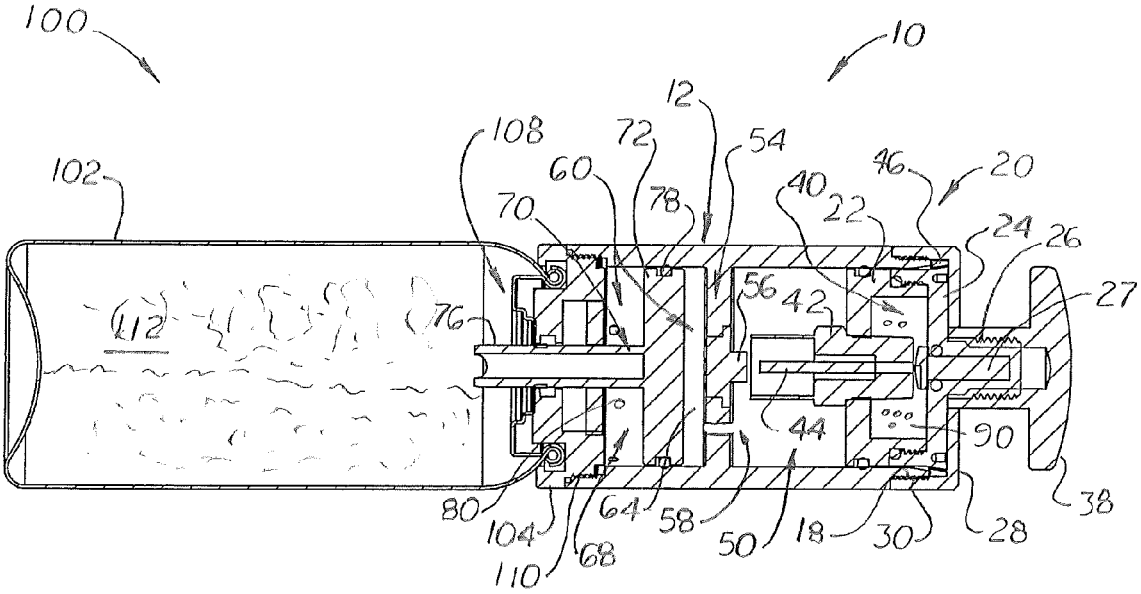
FIG. 2 is a sectional side elevational view of the delayed release pressurized gas canister shown in FIG. 1.

Also as shown in FIG. 2, located inside the main body 12 and below and adjacent to the second chamber 50 is an intermediate strut 54. Formed on the strut 54 is a central, coaxially aligned support post 56. As discussed above, when the first plunger assembly 20 is forced inward, the activation pin 44 presses against the support post 56 causing compressed air 90 in the first chamber 40 to be released into the second chamber 50.

The intermediate strut 54 includes at least one air conduit 58 that communicates with a third chamber 60 located on the opposite side of the intermediate strut 54. Located inside the third chamber 60 is a second plunger assembly 70 that divides the third chamber 60 into an upper filling chamber 64 and a lower discharge chamber 68. The air conduit 58 allows compressed air 90 to pass with a restricted flow from the second chamber 50 into the upper filing chamber 64.

The second plunger assembly 70 includes an upper plunger head 72 and a perpendicularly aligned hollow stem 76. An O-ring 78 is disposed around the outer surface of the plunger head 76 to create an air tight seal between the plunger head 72 and the inside surface of the third chamber 60. When the device 10 is initially attached to the canister 100 as shown in FIGS. 1 and 2, the stem 76 on the second plunger assembly 70 partially extends into the top valve assembly 108 but does not activate the top valve assembly 108.

When sufficient compressed air 90 enters the upper filing chamber 64, the plunger head 72 on the second plunger assembly 70 is forced inward that forces the hollow stem 76 into canister body 102. When the distal end of the hollow stem 76 communicates with the pressurized aerosol gas, the aerosol gas flows quickly into the stem 76 and into the lower discharge chamber 68 located in the main body 12. Holes 80 formed in the main body 12 surrounding the lower discharge chamber 68 allow the smoke or aerosol gas 112 to escape into the surrounding area.

In the embodiment presented herein, the canisters with ¼ inch diameter valves are used. The first chamber is filled with compressed gas between 40 and 150 psi. One air conduit is formed in the intermediate strut with a diameter of approximately 3/1000 inch in diameter. When the pressure of the compressed gas is 100 psi, release of the smoke or gas 112 from the device begins approximately 2 seconds after activation of the plunger handle. When the pressure of the compressed gas is 60 psi, release of the smoke or gas from the device begins approximately 10 seconds after activation of the plunger handle.

In summary, the release of compressed gas 90 from the first chamber 40 and its sequential flow from the first chamber 40 into the second chamber 50 and then into the upper filling chamber 64 and the exertion of pressure on the second plunger assembly 70 in the third chamber 60 creates a simple mechanical time delay mechanism that is relatively inexpensive and less prone to failure. By adjusting the pressure of the compressed air 90 in the first chamber 40 and the diameter of the air conduit 58 between the second and third chambers 50, 60, respectively, the manufacturer can change the time delay.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A delay timing device for a canister filled with pressurized gas with a top canister valve assembly, said device comprising;

a. a cylindrical main body with an upper end opening and a lower end opening, said lower end opening configured to be mounted over the top canister valve assembly;

b. a plunger assembly mounted inside said main body adjacent to said upper end opening, said plunger assembly includes an inner cap with a longitudinally aligned neck, said inner cap configured to slide longitudinally inside said main body, said plunger assembly also includes an inner body with a first chamber located filled with a compressed gas, c. an external air valve connected to said plunger assembly and configured to supply compressed air to said first chamber;

d. a second chamber located inside said main body and adjacent to said first chamber;

e. an inner valve located inside said main body and coupled to said plunger assembly that releases compressed air from said first chamber into said second chamber when said plunger assembly is forced into said main body;

f. means for locking said plunger assembly in said main body when said forced inward;

g. means for sealing said second chamber when said plunger assembly is forced inward enabling the second chamber to be pressurized;

f. an intermediate strut formed said main body and below said second chamber, said intermediate strut includes at least one air conduit;

g. a third chamber located inside said main body and below said intermediate strut, said third chamber being connected to said air conduit so that compressed air flowing into said second chamber flows also into said third chamber;

h. a second plunger assembly located inside main body and adjacent to said third chamber, said second plunger assembly configured to divide said third chamber into an upper gas chamber and a lower discharge chamber, said second plunger assembly includes a perpendicularly aligned hollow stem longitudinally aligned with said main body and extends downward from said lower end opening, said stem being sufficient in length to partially extend into said top valve assembly on said canister when said main body is attached to said canister and forced inward to transfer pressurized gas located inside said canister to said lower discharge chamber;

i. a plurality of side holes formed on said main body adjacent to said lower discharge chamber, and;

j. whereby when said first chamber is filled with compressed air and said plunger assembly is forced inward, said compressed air in said first chamber is sequentially released into said second chamber and then through said air conduit and into said second plunger assembly, when sufficient pressure is exerted on said second plunger assembly, the stem on said second plunger assembly is forced into said canister and pressure smoke or gas inside said canister is delivered through the stem in into the lower discharge cavity on said main body and then into said side holes.

2. The device, as recited in claim 1, wherein said compressed air is between 40 and 120 psi.

3. A delay release gas filled pressurized canister, comprising;

a. a pressurized gas with a top canister valve assembly;

b. a cylindrical main body longitudinally aligned and attached over said top canister valve assembly, said main body includes an upper end opening and a lower end opening;

c. a plunger assembly mounted inside said main body adjacent to said upper end opening, said plunger assembly includes first chamber filled with compressed air;

d. an external air valve that communicates with said first chamber;

e. a second chamber located inside said main body and adjacent to said plunger assembly;

f. an inner valve located inside said main body and coupled to said plunger assembly that releases compressed air from said first chamber into said second chamber when said plunger assembly moves longitudinally inside said main body;

g. an intermediate strut formed said main body and below said second chamber, said intermediate strut includes at least one air conduit;

h. a second plunger assembly located inside main body below and adjacent to said intermediate strut, said second plunger assembly configured to divide volume of space inside said main body below said intermediate strut into an upper gas chamber and a lower discharge chamber, said second plunger assembly includes a perpendicularly aligned hollow stem longitudinally aligned with said main body and extends downward from said lower end opening and partially extends into said top valve assembly on said canister when said main body is attached to said canister and transfer pressurized gas located inside said canister to said lower discharge chamber when said second plunger assembly is forced longitudinally towards said canister; and, i. a plurality of side holes formed on said main body adjacent to said lower discharge chamber enabling pressurized gas inside said canister delivered through the stem in into the lower discharge cavity to escape.

* * * * *